US006283234B1

(12) United States Patent
Torbet

(10) Patent No.: US 6,283,234 B1
(45) Date of Patent: Sep. 4, 2001

(54) APPARATUS FOR MOUNTING PCD COMPACTS

(75) Inventor: Christopher J. Torbet, Chelsea, MI (US)

(73) Assignee: Sylvan Engineering Company, Chelsea, MI (US)

( * ) Notice: Subject to any disclaimer, the term of this patent is extended or adjusted under 35 U.S.C. 154(b) by 0 days.

(21) Appl. No.: 09/397,901

(22) Filed: Sep. 17, 1999

(51) Int. Cl.[7] ..... E21B 10/62
(52) U.S. Cl. ..... 175/432; 175/430; 175/413
(58) Field of Search ..... 175/432, 430, 175/428, 413

(56) References Cited

U.S. PATENT DOCUMENTS

| | | | | |
|---|---|---|---|---|
| 2,506,341 | * | 5/1950 | Bullock | 175/413 |
| 2,631,360 | | 3/1953 | Sanford et al. . | |
| 2,710,180 | * | 6/1955 | Graham | 175/413 |
| 2,917,819 | | 12/1959 | Britton et al. . | |
| 3,136,615 | | 6/1964 | Bovenkerk et al. . | |
| 3,141,746 | | 7/1964 | De Lai . | |
| 3,271,080 | | 9/1966 | Gowanlock . | |
| 3,749,190 | | 7/1973 | Shipman . | |
| 4,047,583 | | 9/1977 | Dyer . | |
| 4,057,884 | | 11/1977 | Suzuki . | |
| 4,199,035 | * | 4/1980 | Thompson | 175/413 |
| 4,337,980 | * | 7/1982 | Krekeler | 299/91 |
| 4,466,498 | | 8/1984 | Bardwell . | |
| 4,511,006 | * | 4/1985 | Grainger | 175/57 |
| 4,553,615 | * | 11/1985 | Grainger | 175/354 |
| 4,654,947 | | 4/1987 | Davis . | |
| 4,694,918 | | 9/1987 | Hail . | |
| 4,782,903 | * | 11/1988 | Strange | 175/413 |
| 5,007,685 | | 4/1991 | Beach et al. . | |
| 5,332,051 | * | 7/1994 | Knowlton | 175/430 |
| 5,351,772 | * | 10/1994 | Smith | 175/428 |
| 5,469,927 | * | 11/1995 | Griffin | 175/432 |
| 5,678,645 | * | 10/1997 | Tibbitts et al. | 175/426 |
| 5,810,103 | | 9/1998 | Torbet . | |

* cited by examiner

*Primary Examiner*—Hoang Dang
(74) *Attorney, Agent, or Firm*—Young & Basile, P.C.

(57) ABSTRACT

A method and apparatus for improved attachment of an ultra-hard compact, especially a two-layer disk-type PCD compact, to a tool or support surface with a mechanical connection. In general the ultra-hard compact is provided with a tool-engaging threaded end protruding from the compact. The threaded end may be facilitated by a post fitted into a blind hole in the ultra-hard compact, or may be facilitated by a threaded sleeve permanently attached to the ultra-hard compact. In any case, when the ultra-hard compact is threadably engaged into a tool or support surface, the fastening means is hidden with only the wear resistant materials of the ultra-hard compact exposed.

5 Claims, 4 Drawing Sheets

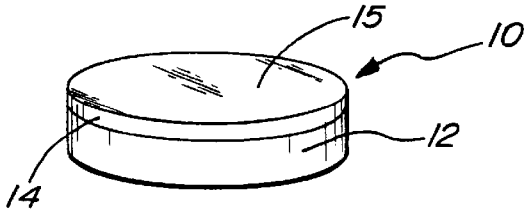
FIG - 1
PRIOR ART
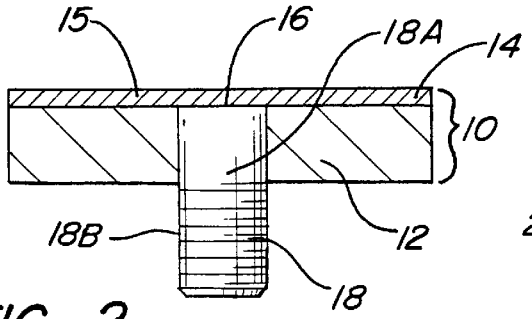
FIG - 2
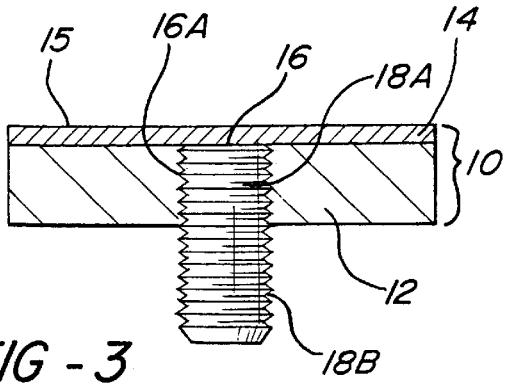
FIG - 3
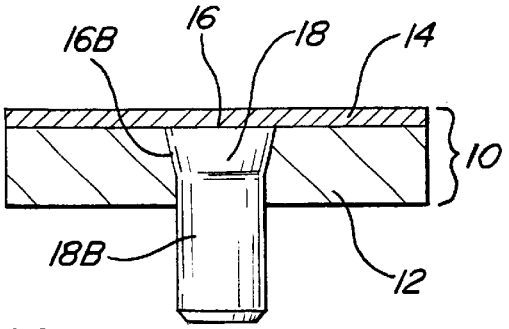
FIG - 4
FIG - 5
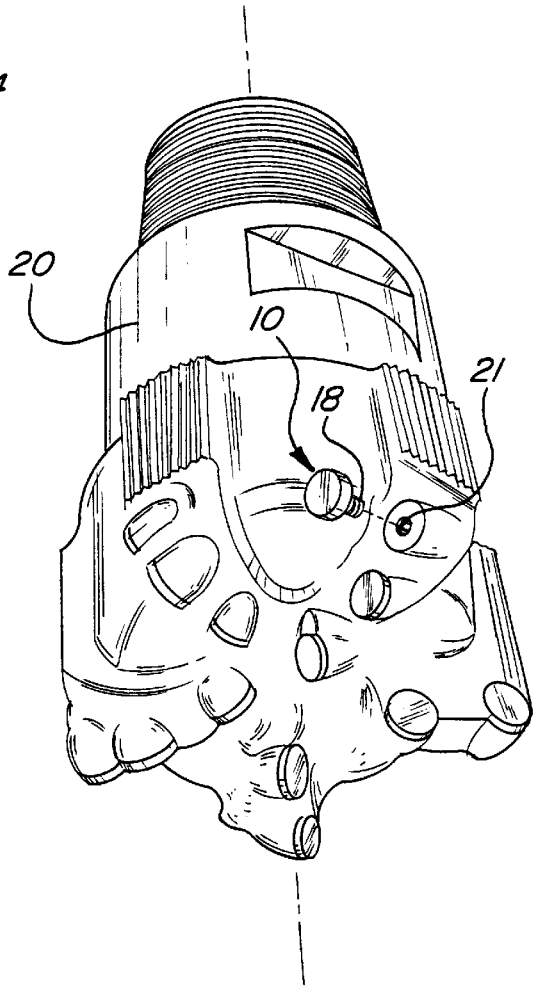

FIG-9A
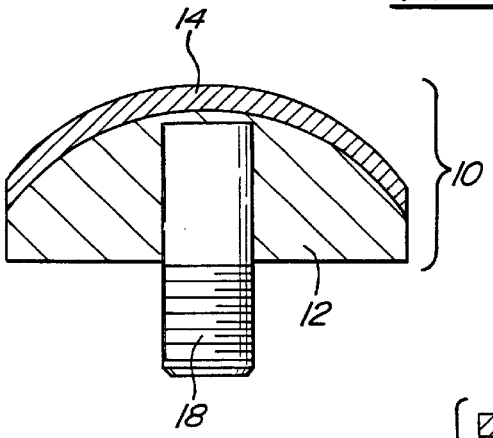
FIG-10
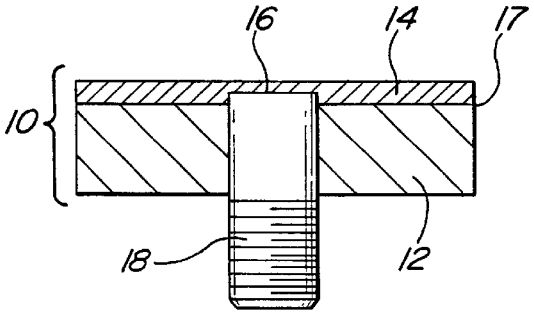
FIG-11
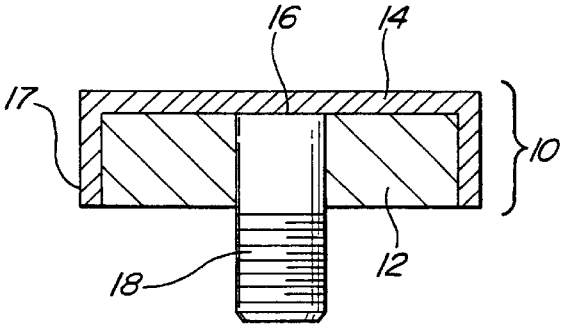
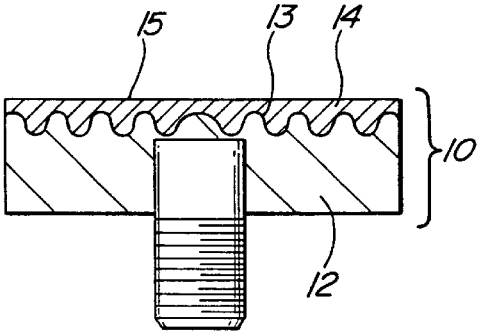
FIG-12
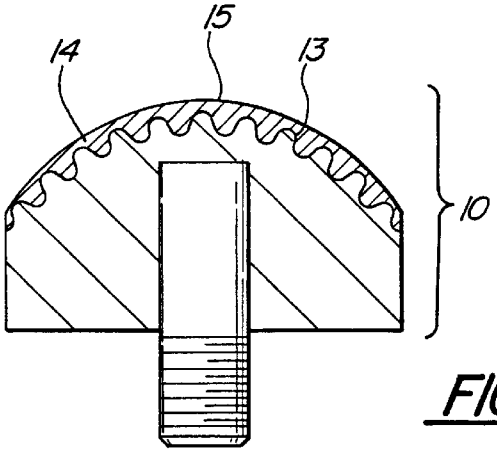
FIG-13

APPARATUS FOR MOUNTING PCD COMPACTS

FIELD OF THE INVENTION

The present invention relates to ultra hard cutting elements known as PCD (polycrystalline diamond) compacts, PCBN (polycrystalline cubic boron nitride) compacts, or compacts containing other ultra-hard material, and more particularly to the manner in which such compacts are mounted on cutting tools or other support surfaces.

BACKGROUND OF THE INVENTION

Ultra-hard compacts are used as small cutting or wear elements in various shapes, often disks, consisting of a stiff substrate with a (preferably) high modulus of elasticity such as cemented carbide. This preferably stiff substrate supports an ultra-hard cutting layer typically containing diamond or CBN (cubic boron nitride) and possibly other materials such as sintering aids, binders, and secondary abrasives. The ultra-hard layer is used as the cutting or wear resistant cutting surface, and is typically found on the cutting faces of rock drills and other industrial cutting tools required to cut or drill through hard, abrasive materials.

While the above description of an ultra-hard compact is representative of commercially available compacts, the composition of the substrate/ultra hard layer compact can vary in a manner known to those skilled in the art. For example, a substrate may comprise something other than carbide-type materials when used in applications that do not demand high loading conditions. The ultra-hard layer may comprise multiple layers of different composition, or a layer which varies from one side to the other, and may be flat or curved or irregular. There may be non-planar interfaces between differing materials on the compact interior. In addition, there may be chip breakers or special contours on the exterior surfaces. These and other known variations will be apparent to those skilled in the art.

The commercially available geometry and extreme hardness of ultra-hard compacts renders them difficult to attach and replace on cutting tools such as rock drills. Prior art methods of attachment typically involve brazing the substrate onto the tool face, but there are several problems inherent in the brazing method of attachment. The part onto which the PCD is being brazed needs to be heated with special equipment; brazing skill, like welding skill, is variable among operators; certain tools and environments do not tolerate the heat involved in the brazing process; brazing can cause thermal damage to the PCD compact itself; and, brazed ultra-hard compacts are difficult to replace or repair.

There have been attempts to improve the manner in which hard cutting elements are attached to cutting tools. For example, U.S. Pat. No. 4,694,918 to Hall discloses a PCD compact having a cylindrical portion sized for a press-fit into a drill bit or similar tool surface. The compacts are embedded in the bit by press-fitting or brazing them into the head of the bit.

U.S. Pat. No. 4,057,884 to Suzuki discloses a tool holder in which a cemented carbide type cutting bit has a hole formed through it for attachment to a tool with a bolt mechanism. The Suzuki attachment structure is designed for a compact with uniform (non-ultra hard) material having an angular, lateral cutting edge, rather than a PCD type compact with an ultra-hard cutting face.

U.S. Pat. Nos. 3,136,615 and 3,141,746 mention without explanation the use of "mechanical joints" to secure a cutting compact to a tool, for example: "mechanical joints also may be employed in the compact oriented in holder 27 in various arrangements depending on compact configuration" (column 4, lines 64–66 of the '746 patent). Also: "The compact is attached to some support in various position by soldering or brazing, for example, a titanium hydride soldering process as given in U.S. Pat. No. 2,570,428, Kelley, or by mechanical attaching means, or by having the tool or adjacent metal be forced into the surface irregularities of the compact" (column 6, lines 17–23 of the '746 patent).

U.S. Pat. No. 4,199,035 to Thompson discloses a threaded attachment system for mounting a stud- or pin-shaped PCD compact on a drill bit by way of an external threaded sleeve mating with a threaded bushing in the drill bit. The sleeve holds the compact in place in an interference-type fit as it is threaded down into the tool-mounted bushing over the compact. This patent additionally discloses a metal locating pin mounted on the tool to slide fit into a recess in the lower surface of the stud toward the edge of the stud to locate the stud at the proper rotational angle for cutting.

The above-described prior art has not fully satisfied the need for a simple, efficient method for attaching PCD compacts to a tool or other support surface. The invention described below solves this problem.

SUMMARY OF THE INVENTION

The present invention is an improved mounting arrangement for a PCD compact, and in general takes the form of a blind bore formed in the relatively softer substrate of the ultra-hard compact, the blind bore receiving a mechanical fastening element therein to permanently secure the fastening element to the compact. Or the mounting arrangement may take the form of a modified protrusion of the substrate, also creating a permanently secured fastening element on the compact. The mechanical fastening element is designed to be easily attached to a tool or support surface. In a preferred form the mechanical fastener is a threaded post protruding from the substrate end of the ultra-hard compact to facilitate easy mounting and replacement of the compact on the tool face or support surface. When mounted, the fastening means is hidden with only the wear resistant materials of the ultra-hard compact exposed.

In an alternate embodiment, the blind bore is formed with an internal thread to accept a mechanical fastener in threaded engagement.

In another alternate embodiment, the external surface of the substrate is threaded to provide an integral threaded protrusion to facilitate a mechanical means of attaching the ultra-hard compact to a tool or support surface.

In yet another alternate embodiment, a threaded sleeve element is permanently attached onto a post-like substrate protrusion, resulting in an integral threaded protrusion.

The above embodiments can further be modified with an ultrahard layer extended down and around the substrate to fully enclose and protect the portion of the substrate extending above the surface of the tool on which it is mounted. In doing so, the mechanical fastener extending from the mounting face of the substrate is further protected from wear.

BRIEF DESCRIPTION OF THE DRAWINGS

FIG. 1 is a perspective front view of a prior art PCD compact;

FIG. 2 is a side section view of a PCD compact with an improved mounting arrangement according to the present invention;

FIG. 3 is a side section view of an alternate mounting arrangement according to the invention;

FIG. 4 is yet another embodiment of a mounting arrangement for a PCD compact according to the present invention;

FIG. 5 illustrates a typical tool on which a PCD compact according to the present invention would be employed;

FIGS. 9 and 9A illustrate the improved mounting arrangement of the present invention used with PCD compacts having different surface geometries;

FIG. 10 is a further embodiment according to the present invention where the termination point of the mechanical faster is in the ultra-hard layer;

FIG. 11 illustrates an embodiment of the invention with the ultrahard layer extended down and around the substrate layer to a point flush with the substrate's mounting face;

FIGS. 12 and 13 illustrate the improved mounting arrangement of the present invention used with an ultra-hard compact that has a non-planar or irregular interface between the ultra-hard layer and substrate;

DETAILED DESCRIPTION OF THE DRAWINGS

FIG. 1 illustrates a typical disk-shaped PCD compact 10 comprising a lower substrate layer 12 and an ultra-hard upper layer 14. In the illustrated embodiment the substrate layer 12 is formed from conventional cemented carbide material with a high modulus of elasticity to provide a very stiff body to support the ultra-hard layer 14. The ultra hard layer 14, in turn, is formed from a conventional cemented or sintered diamond or CBN particulate, and is significantly harder than the substrate to provide a durable cutting or wear surface.

Figure 9:
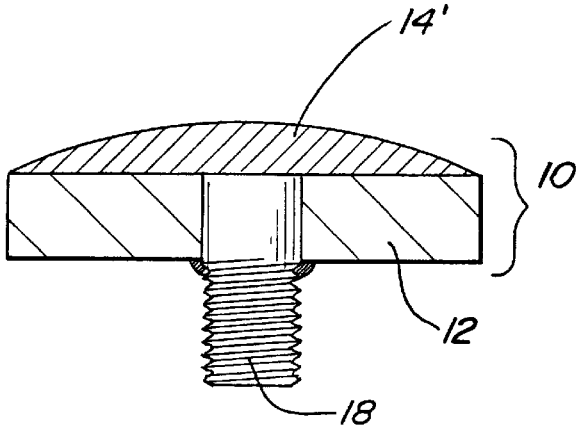

Although the PCD compact 10 in FIG. 1 is illustrated with a flat upper surface 15, it will be apparent to those skilled in the art that curved or domed-shaped upper surfaces are available, for example as illustrated in FIG. 9. Also, it will be apparent to those skilled in the art that non-planar interfaces on the interior of the compacts are available, for example as illustrated in FIGS. 12 and 13.

FIG. 2 illustrates the conventional PCD compact 10 of FIG. 1, modified according to the present invention so that it can be easily and inexpensively secured to a cutting tool or other support surface without the need for brazing or other complicated prior art techniques. A blind bore 16 is formed in substrate 12 opposite ultra-hard layer 14, blind bore 16 opening onto the lower surface 12*a* of the substrate. Blind bore 16 terminates in substrate 12 at ultra-hard layer 14. In the illustrated embodiment blind bore 16 is a cylindrical bore, although other geometries such as triangular, rectangular, and tapered bores are possible. Blind bore 16 may also terminate in the substrate below ultrahard layer 14, i.e. with substrate between the end of the bore and the ultrahard layer.

Blind bore 16 receives a mechanical fastener 18 permanently secured to the PCD compact under normal working conditions. In the illustrated embodiment the mechanical fastener 18 is a metal post with an insert end 18*a* secured in the blind bore, and a threaded tool engaging end 18*b* protruding from the PCD compact for attachment to a tool or support surface. Blind bore 16 is preferably formed in the rotational center of the PCD compact for ease in threading post 18 into an aperture on a tool or support surface.

Once secured in PCD compact 10, post 18 and PCD compact 10 form a solid, integral unit carrying its own mechanical fastening structure for simple, fast attachment to or removal from a tool. This is a significant improvement over the prior art brazing and mechanical attachment methods, since it requires no external apparatus or fastening structure; PCD compact 10 and post 18 can simply be threaded onto a tool as a self-contained unit.

The invention is also an improvement over the prior art attachment methods which require drilling a hole completely through a cutting element. The ultra-hard layer 14 on PCD compact 10 does not lend itself to having a hole or bore formed therethrough, in part due to its hardness, and such a bore would both damage its structural integrity and leave the relatively soft mechanical fastener portion exposed on the upper cutting face 15, where it would quickly be degraded.

The invention is also an improvement over structures such as that shown in the Thompson patent described above. Thompson requires separate threaded insert sleeves and bushings which fit over the PCD compact, suitable only for elongated, pin or stud-shaped PCD compacts. The exposed portions of Thompson's bushings would quickly erode under normal operating conditions, whereas the substrate-mounted fastener 18 on the tool-engaging side of the present inventive compact is protected. The present invention also does not require anti-rotation or locating structure such as that needed for Thompson's externally threaded sleeve fitted over the sides of the compact.

Referring now to FIG. 3, an alternate embodiment of the invention is shown in which the fastener post is threaded at both ends 18*a*, 18*b* so that it can be threadably attached to the PCD compact before attaching the integral unit to a tool. In this embodiment blind bore 16 is provided with internal threads 16*a* to accept the threaded insert end 18*a* of the post 18.

Referring now to FIG. 4, yet a further embodiment is illustrated in which blind bore 16 is formed with at least a portion tapered in cross-section, and fastener post 18 is secured to the PCD compact 10 in a swage-fit in which its insert end 18*a* is deformed to fill the tapered region 16*b* of blind bore 16 such that it cannot be removed.

Referring now to FIG. 5, a typical compact-supporting surface, here a rock drill bit tool, is illustrated schematically with a plurality of mechanically-mounted PCD compacts according to the embodiments of the invention in FIGS. 2 and 3 which can be attached to its cutting surfaces. FIG. 5 illustrates the manner in which threaded PCD compacts 10 can be threaded into mating apertures 21 formed in the tool to install compacts 10. The direction of rotation of the threaded coupling between the PCD compact 10 and tool 20 can be set to complement the direction of rotation of the drill bit or tool so that the PCD compacts are not loosened by the cutting action of the tool. Additionally, it is possible to supplement the threaded connection between compacts 10 and apertures 21 with known techniques such as thread-locking adhesives or washers.

It will be understood by those skilled in the art that the blind bore 16 in the PCD compact substrate can be formed in situ as part of the original manufacturing process for the PCD compact. Alternately it can be formed afterwards using known methods such as ultrasonic abrasive machining, abrasive jet machining, grinding, electrical discharge machining, laser, or electrochemical machining.

It will also be understood by those skilled in the art that the configuration of the blind bore 16 in substrate 12 can take forms other than the cylindrical bore illustrated in FIGS. 2–4. For example, it can be a straight bore with either a smooth or rough finish; it can be a tapered bore; it can have a barbed internal surface to assist in swage- or interference-fits; or, as described above, it may be a bore with an internal thread.

Securing the mechanical fastener 18 to PCD compact 10 in blind bore 16 can be done mechanically, for example by the above-described threaded connection, or by swaging or upsetting; thermally, for example by brazing or welding as shown in FIG. 2; or, chemically using an adhesive (FIG. 2).

The present invention is suitable for application in grinding, crushing, and milling equipment. This type of equipment is widely used by many industries for comminution of ores and various hard, crushable materials. The invention lends itself to being incorporated easily into existing equipment to strategically place an ultrahard wear resistant element at a location that is most prone to wear. The benefits of using the invention as described are several-fold. The useful life of equipment would be extended which means improved consistency and less downtime. The wear elements are field replaceable which reduces maintenance time. Also, the ultra-high modulus property of the wear elements lends itself to providing an energy savings for a crushing application.

Figure 6:
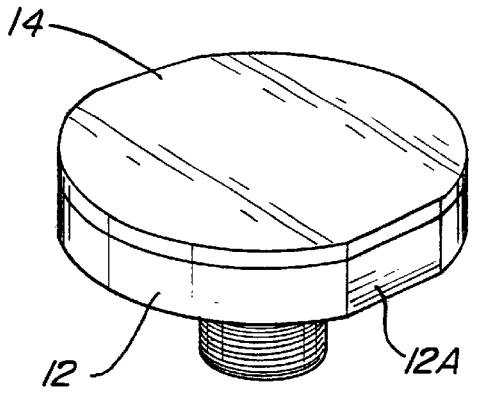
FIGS. 6 and 7 are alternate embodiments of the inventive compact illustrated in FIGS. 2–5, including external assembly-assisting surfaces formed in the compact.
Figure 7:
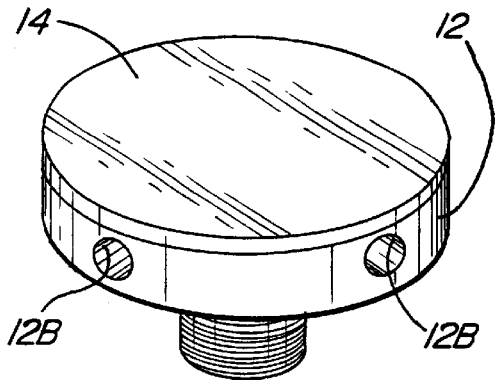

FIGS. 6 and 7 illustrate the formation of tool-receiving surfaces on PCD compact 10 to assist in assembling the threaded post versions of the invention to the desired surface. FIG. 6 illustrates wrench flats 12*a* formed on the external surface of the compact. The compact in FIG. 7 is provided with spanner wrench holes 12*b*. Other tool-receiving surfaces are possible to accommodate known tools.

Figure 8:
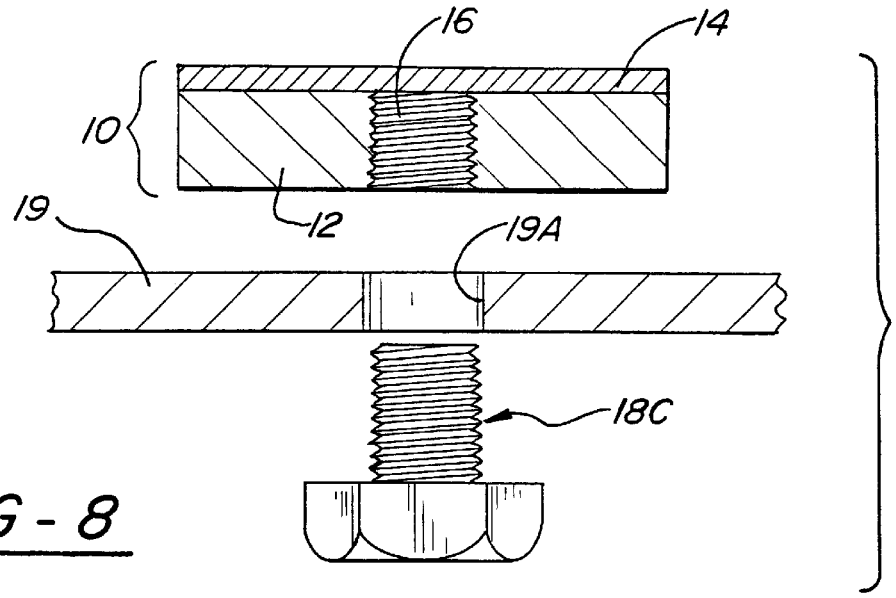
FIG. 8 illustrates a further embodiment in which the mounting structure is separated from the compact to mount the compact to a tool.

FIG. 8 illustrates yet a further embodiment in which mounting post 18*c* (preferably threaded) is separated from PCD compact 10 for assembly of the compact to a tool surface 19, inserted through hole 19*a* provided for that purpose, and subsequently reassembled to bore 16. In this manner the mounting post can be conveniently stored with the PCD compact in an assembled state, if desired.

Through-hole mounting as shown in FIG. 8 would be most suitable for attaching a PCD compact according to the invention to a tool of relatively thin cross section, such as a cutting blade. In through-hole mounting applications, having the PCD compact separate from the threaded post provides added versatility in mounting. The tool that the PCD is mounted to may have a through-hole of any depth. The depth is accommodated simply by selecting a fastener of the proper length. In this manner, it is only necessary to inventory relatively inexpensive fasteners of varying shank length rather than PCD compacts with varying post lengths.

FIG. 9 illustrates another embodiment which shows a PCD compact 10 with non-planar ultra-hard upper layer 14 and a planar upper surface substrate 12. FIG. 9A illustrates a PCD compact 10' with a non-planar ultra-hard upper layer 14 and a non-planar upper surface of the substrate 12.

FIG. 10 illustrates an embodiment of the invention where the termination point of the blind bore 16 and threaded post 18 is in the ultra-hard layer 14, above the interface plane 17 between layers 12 and 14. Bore 16 extends up into, but not all the way through, ultra-hard layer 14. Terminating bore 16 in ultra-hard layer 14 provides a deeper hole and creates a significantly strengthened attachment of the post 18 to the compact 10.

FIG. 11 illustrates a PCD type compact 10 where the ultra-hard layer 14 extends down around the outer circumference of the compact 10. In this embodiment the blind bore 16 does not penetrate into the ultra-hard layer 14, but the lower-most plane 17 of the ultrahard layer is again below the termination point of the blind bore 16 and the attachment post 18. When the threaded compact assembly of FIG. 11 is mounted on a flat surface, only ultra-hard material is exposed and the substrate and fastener are fully protected.

FIGS. 12 and 13 illustrate versions of the invention with a non-planar interface 13 between the ultra-hard layer 14 and the substrate 12. FIG. 12 illustrates a PCD type compact 10 according to the invention with a planar ultra-hard upper surface 15 and a non-planar substrate upper surface 13. FIG. 13 illustrates a PCD type compact 10 according to the invention with a non-planar ultra-hard upper surface 15 and a non-planar substrate upper surface. Non-planar substrate upper surfaces 13 can be used to alter the wear characteristics of the compact, or can be used to modify the stresses in a compact to improve edge impact properties, for instance. Non-planar ultra-hard upper surface 15 as shown in FIG. 13 can be used to provide certain loading conditions on the compact for a particular application, or for chip control of material being removed in a cutting tool application. It will be apparent to those skilled in the art that the term "non-planar" can cover a very wide range of geometries from simple curves to very complex combinations of compound curves, steps, grooves, and pockets.

Figure 14:
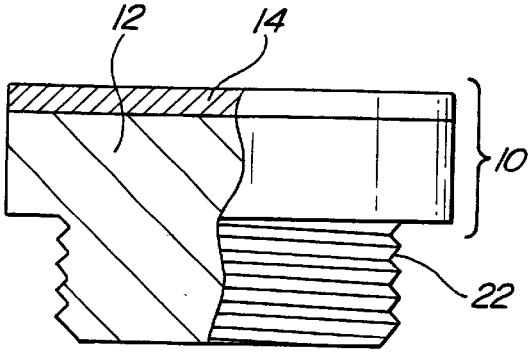
FIG. 14 illustrates another mounting arrangement of the present invention in which the mechanical fastener is an integral extension of the substrate material.

FIG. 14 illustrates an alternative threaded mechanical fastener on a PCD type compact 10. External threads 22 are formed in an integral extension of the material of substrate 12. It will be understood by those skilled in the art that the threaded section of the substrate may be formed as part of the original manufacturing process for the compact, or alternately may be formed afterwards using known methods such as grinding or electrical discharge machining, for example. This embodiment of the present invention provides a large threaded cross section while maintaining a continuous high modulus support under most or all of the ultra-hard layer 14. Also, this embodiment creates an installed compact tool with a higher aspect ratio. Both of these improved features result in a more robust threaded ultrahard tool able to perform under higher load conditions.

Figure 15:
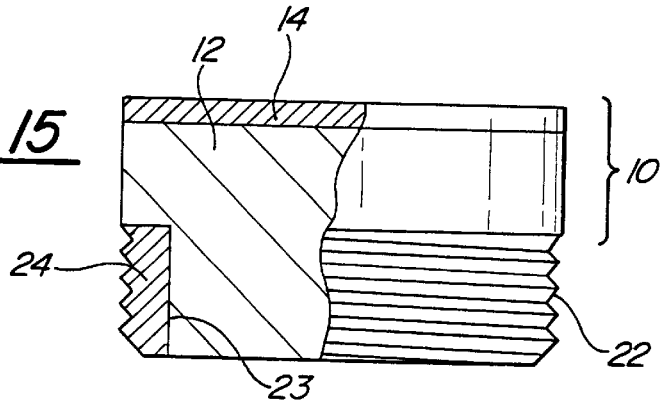
FIG. 15 is another embodiment according to the present invention utilizing a threaded sleeve permanently fastened to an extended portion of the substrate; and, FIGS. 16 and 17 illustrate yet further extended-ultrahard embodiments of the present invention which, when mounted, provide only ultra-hard layer exposure.

FIG. 15 is another embodiment of the present invention which utilizes an integral protrusion 23 of the substrate material 12 onto which external threads 22 are secured rather than formed directly in the substrate material. A threaded sleeve 24 is permanently attached to the extended substrate post 23. The sleeve may be any material, for example steel, preferably a material with high tensile strength, and may be permanently attached by methods well known in the art such as with adhesives, shrink fitting, swaging, welding, or by brazing, for example. Once attached, the threaded sleeve 24 becomes an integral part of the compact body 10. Applying the threads in this manner provides improved flexibility in manufacturing a threaded PCD type compact. A plain post 23 is relatively easy to form as an extension of substrate 12, and the softer material of threaded sleeve 24 is easy to fabricate as well.

Figure 16:
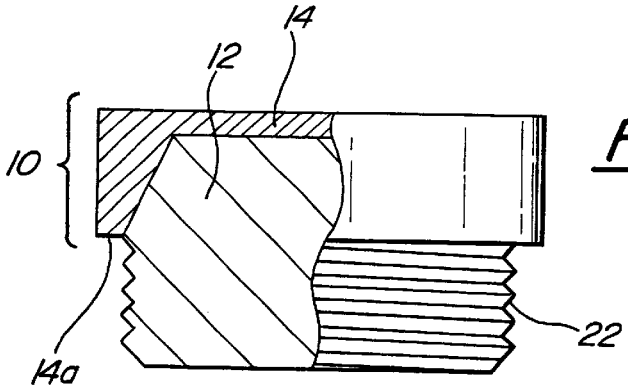

FIG. 16 is yet another embodiment of the invention as it applies to a PCD type compact 10. The substrate 12 and threaded extension 22 are a unified high modulus material, preferably cemented tungsten carbide. The ultra-hard layer 14 extends down around the perimeter of the compact body 10 enclosing the substrate material, so that when the compact is installed onto a mounting surface, only ultra-hard material 14 is exposed. In this embodiment with the large-diameter threaded substrate extension, the mounting face of the compact actually comprises ultrahard material 14, as indicated at 14*a*.

Figure 17:
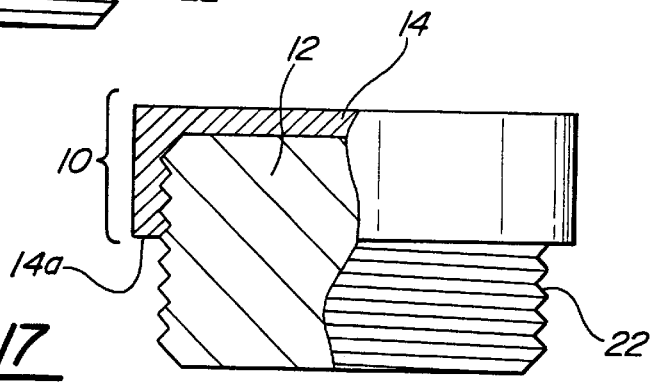

FIG. 17 is a further embodiment illustrating a substrate 12 and threaded post 22 of unified material. The threaded post extends up into the ultra-hard layer 14. This is an example of forming an in-situ threaded post as an integral part of the compact 10. This model is particularly well suited for manufacturing ultra-hard compacts whereas the ultra-hard particles are molded with the aid of a binder at relatively lower pressure and temperature.

The above improvements over prior art techniques for attaching compacts not only simplifies attachment to traditional cutting tools, but opens up possibilities for using compacts on non-traditional surfaces, whenever ultra-hard cutting elements or ultra-hard wear-resistant surfaces are desired.

It will therefore be understood by those skilled in the art that the foregoing illustrative embodiments of my invention are exemplary in nature, and are not intended to limit the invention beyond the scope of the following claims.

I accordingly claim:

1. An ultra-hard compact having self-contained means for attaching the compact in secure fashion to a tool or support surface, comprising:

an ultra-hard compact having a substrate layer and an ultra-hard layer formed from a material having a hardness greater than that of the substrate layer, the substrate layer having a mounting face defining a tool-engaging surface of the compact, and the ultra-hard layer having a face defining an outer cutting or wear resistant surface of the compact;

mechanical fastener means extending from the substrate layer mounting face and forming an integral part of the ultra-hard compact, the fastener means including a tool-engaging end protruding from the mounting face of the ultra-hard compact for mechanically securing the compact to a tool or support surface;

wherein the mechanical fastener means comprises an integral extension of the substrate layer material formed into a tool-engaging end protruding from the mounting face of the compact;

wherein the integral extension of substrate material is provided with an external sleeve of a different material attached thereto, the external sleeve being adapted to be mechanically fastened to a mating aperture of a tool or support surface; and wherein the external sleeve is threaded to threadably engage a mating threaded aperture on a tool or support surface.

2. An ultra-hard compact having self-contained means for attaching the compact in secure fashion to a tool or support surface, comprising:

an ultra-hard compact having a substrate layer and an ultra-hard layer formed from a material having a hardness greater than that of the substrate layer, the substrate layer having a mounting face defining a tool-engaging surface of the compact, and the ultra-hard layer having a face defining an outer cutting or wear resistant surface of the compact;

mechanical fastener means extending from the substrate layer mounting face and forming an integral part of the ultra-hard compact, the fastener means including a tool-engaging end protruding from the mounting face of the ultra-hard compact for mechanically securing the compact to a tool or support surface;

wherein the mechanical fastener means comprises an integral extension of the substrate layer material formed into a tool-engaging end protruding from the mounting face of the compact;

wherein the integral extension of the substrate material is threaded to threadably engage a mating threaded aperture on a tool or support surface;

wherein the entire substrate layer is threaded, and an upper end of the threaded substrate layer threadably mates with a threaded blind bore formed in the ultra-hard layer.

3. An ultra-hard compact having self-contained means for attaching the compact in secure fashion to a tool or support surface, comprising:

an ultra-hard compact having a substrate layer and an ultra-hard layer formed from a material having a hardness greater than that of the substrate layer, the substrate layer having a mounting face defining a tool-engaging surface of the compact, and the ultra-hard layer having a face defining an outer cutting or wear resistant surface of the compact;

mechanical fastener means extending from the substrate layer mounting face and forming an integral part of the ultra-hard compact, the fastener means including a tool-engaging end protruding from the mounting face of the ultra-hard compact for mechanically securing the compact to a tool or support surface;

wherein the mechanical fastener means comprises an integral extension of the substrate layer material formed into a tool-engaging end protruding from the mounting face of the compact;

wherein the ultra-hard layer completely encloses the substrate layer above and peripherally around the mounting face such that when the compact is mounted on a tool or support surface with the mounting face against the tool or support surface, no portion of the substrate layer is exposed.

4. An ultra-hard compact having self-contained means for attaching the compact in secure fashion to a tool or support surface, comprising:

an ultra-hard compact having a substrate layer and an ultra-hard layer formed from a material having a hardness greater than that of the substrate layer, the substrate layer having a mounting face defining a tool-engaging surface of the compact, and the ultra-hard layer having a face defining an outer cutting or wear resistant surface of the compact;

mechanical fastener means extending from the substrate layer mounting face and forming an integral part of the ultra-hard compact, the fastener means including a tool-engaging end protruding from the mounting face of the ultra-hard compact for mechanically securing the compact to a tool or support surface;

wherein the compact includes a blind bore formed in the mounting face of the substrate layer, the blind bore terminating in the interior of the compact, and further wherein the mechanical fastener means is inserted in and secured to the blind bore so as to make it an integral part of the compact, with its tool-engaging end protruding from the blind bore in the mounting face of the compact;

wherein the blind bore terminates in the ultra-hard layer and the mechanical fastener means is secured at one end to the ultra-hard layer.

5. An ultra-hard compact having self-contained means for attaching the compact in secure fashion to a tool or support surface, comprising:

an ultra-hard compact having a substrate layer and an ultra-hard layer formed from a material having a hardness greater than that of the substrate layer, the substrate layer having a mounting face defining a tool-engaging surface of the compact, and the ultra-hard layer having a face defining an outer cutting or wear resistant surface of the compact;

mechanical fastener means extending from the substrate layer mounting face and forming an integral part of the ultra-hard compact, the fastener means including a tool-engaging end protruding from the mounting face of the ultra-hard compact for mechanically securing the compact to a tool or support surface;

wherein the compact includes a blind bore formed in the mounting face of the substrate layer, the blind bore terminating in the interior of the compact, and further wherein the mechanical fastener means is inserted in and secured to the blind bore so as to make it an integral part of the compact, with its tool-engaging end protruding from the blind bore in the mounting face of the compact;

wherein the ultra-hard layer encloses the substrate layer above and peripherally around the mounting face such that when the compact is mounted on a tool or support surface with the mounting face against the tool or support surface, no portion of the substrate layer is exposed.

* * * * *

UNITED STATES PATENT AND TRADEMARK OFFICE

CERTIFICATE OF CORRECTION

PATENT NO. : 6,283,234 B1
DATED : September 4, 2001
INVENTOR(S) : Torbet

It is certified that error appears in the above-identified patent and that said Letters Patent is hereby corrected as shown below:

Title page,
Title, delete "APPARATUS FOR MOUNTING PCD COMPACTS" and insert -- METHOD AND APPARATUS FOR MOUNTING PCD COMPACTS --.

Column 3,
Line 18, delete "faster" and insert -- fastener --.

Column 8,
Line 41, delete "and peripherally around" and insert before the word 'above' -- both peripherally and --

Signed and Sealed this

Second Day of April, 2002

*Attest:*

*Attesting Officer*

JAMES E. ROGAN
*Director of the United States Patent and Trademark Office*